US005807529A

United States Patent [19]

Kruse et al.

[11] Patent Number: 5,807,529

[45] Date of Patent: Sep. 15, 1998

[54] PROCESS FOR THE PRODUCTION OF SILICATE-BASED BUILDER GRANULES WITH INCREASED APPARENT DENSITY

[75] Inventors: Hans-Friedrich Kruse, Korschenbroich; Beatrix Kottwitz, Duesseldorf; Volker Bauer, Duesseldorf; Berthold Schreck, Duesseldorf; Joerg Poethkow, Duesseldorf; Wolfgang Breuer, Korschenbroich, all of Germany

[73] Assignee: Henkel Kommanditgesellschaft Auf Aktien, Duesseldorf, Germany

[21] Appl. No.: 732,426

[22] PCT Filed: Apr. 24, 1995

[86] PCT No.: PCT/EP95/01543

§ 371 Date: Nov. 1, 1996

§ 102(e) Date: Nov. 1, 1996

[87] PCT Pub. No.: WO95/29978

PCT Pub. Date: Nov. 9, 1995

[30] Foreign Application Priority Data

May 2, 1994 [DE] Germany ..... 44 15 362.7

[51] Int. Cl.[6] ..... C10B 33/32

[52] U.S. Cl. ..... 423/332; 423/334; 23/313 AS; 264/118; 510/532

[58] Field of Search ..... 423/334, 332; 23/313 AS; 264/118; 510/532

[56] References Cited

U.S. PATENT DOCUMENTS

| | | | |
|---|---|---|---|
| 3,687,640 | 8/1972 | Sams et al. | 23/313 AS |
| 3,782,906 | 1/1974 | Pierce et al. | 23/313 AS |
| 3,832,434 | 8/1974 | Flood et al. | 23/313 AS |
| 3,838,193 | 9/1974 | Kajitani et al. | 423/351 |
| 3,868,227 | 2/1975 | Gericke et al. | 23/313 |
| 3,879,527 | 4/1975 | Bertorelli et al. | 423/332 |
| 3,912,649 | 10/1975 | Bertorelli et al. | 252/135 |
| 3,918,921 | 11/1975 | Pierce | 23/313 AS |
| 3,931,036 | 1/1976 | Pierce | 23/313 AS |
| 3,932,140 | 1/1976 | Jayawant et al. | 23/313 AS |
| 3,956,467 | 5/1976 | Bertorelli et al. | 423/332 |
| 4,126,423 | 11/1978 | Kongsgaarden | 23/313 AS |
| 4,820,439 | 4/1989 | Rieck | 252/135 |
| 4,824,807 | 4/1989 | Blount | 23/313 AS |
| 4,834,902 | 5/1989 | Pioch et al. | 23/313 AS |
| 5,096,609 | 3/1992 | Dany et al. | 252/135 |
| 5,344,581 | 9/1994 | Beck et al. . | |
| 5,393,507 | 2/1995 | Theunissen et al. | 23/313 AS |
| 5,541,316 | 7/1996 | Engelskirchen et al. | 510/471 |
| 5,547,603 | 8/1996 | Sörenson et al. | 423/333 |
| 5,693,304 | 12/1997 | Bongstadt et al. . | |

FOREIGN PATENT DOCUMENTS

| | | |
|---|---|---|
| 0253323 | 1/1988 | European Pat. Off. . |
| 0374017 | 6/1990 | European Pat. Off. . |
| 0488868 | 6/1992 | European Pat. Off. . |
| 0525239 | 2/1993 | European Pat. Off. . |
| 0542131 | 5/1993 | European Pat. Off. . |
| 0561656 | 9/1993 | European Pat. Off. . |
| 2638154 | 4/1990 | France . |
| 4203031 | 8/1993 | Germany . |
| 4221381 | 2/1994 | Germany . |
| 4300772 | 7/1994 | Germany . |
| 4319578 | 12/1994 | Germany . |
| 4330393 | 3/1995 | Germany . |
| 33-217598 | 12/1958 | Japan . |
| 54-024299 | 2/1979 | Japan . |
| WO9013533 | 11/1990 | WIPO . |
| WO9108171 | 6/1991 | WIPO . |
| WO9302176 | 2/1993 | WIPO . |

*Primary Examiner*—Margaret Medley
*Attorney, Agent, or Firm*—Ernest G. Szoke; Wayne C. Jaeschke; Real J. Grandmaison

[57] ABSTRACT

A process for producing silicate or silicate-containing builder granules having an apparent density of at least 600 g/l by compacting silicate materials having an apparent density of less than 500 g/l, a molar ratio of $SiO_2$ to $Na_2O$ of 1.3 to 4, and a water content of up to 15% by weight, wherein the silicate materials are X-ray amorphous and are present in the form of a fine particle solid having a flake structure.

13 Claims, No Drawings

PROCESS FOR THE PRODUCTION OF SILICATE-BASED BUILDER GRANULES WITH INCREASED APPARENT DENSITY

BACKGROUND OF THE INVENTION

1. Field of the Invention

This invention relates to a process for the production of silicate-based or silicate-containing builder granules with apparent densities of at least 600 g/l which show improved performance properties and to detergents or cleaning compositions containing such granules.

2. Discussion of Related Art

Systems containing only silicates, such as the crystalline layer-form disilicates, or combinations of such components with other ingredients of detergents or cleaning compositions have recently been described for use as builders or co-builders. Combinations of sodium carbonates and sodium silicates are also known, cf. European patent applications EP-A-0 488 868 and EP-A-0 561 656.

U.S. Pat. Nos. 3,912,649, 3,956,467, 3, 838,193 and 3,879,527 describe amorphous sodium silicate compounds obtained by spray drying of aqueous waterglass solutions to form light silicates, subsequent grinding, compacting and spheronizing with further removal of water from the ground material (cf. for example FIG. 3 of U.S. Pat. No. 3,912,649) as builders. The products used have a water content of around 18 to 20% by weight for apparent densities well above 500 g/l.

Amorphous sodium disilicates with a low water content of 0.3 to 6% by weight are known from European patent application EP-A-0 444 415. The amorphous sodium disilicate is said preferably to contain 0.5 to 2% by weight of water. These amorphous disilicates with their very low water contents are produced by a multistage process in which a powder-form amorphous sodium silicate with a water content of 15 to 23% by weight is initially prepared. This material is treated in countercurrent with waste gas at temperatures of 250° to 500° C. in a revolving tube furnace. The amorphous sodium silicate leaving the revolving tube furnace is size-reduced to particle sizes of 0.1 to 12 mm by means of a mechanical crusher and is then ground in a mill to particle sizes of 2 to 400 pm.

EP-B-0 374 017 describes typical water-containing high-density silicates in granular form containing 1 to 10% by weight of cellulose derivatives which improves the dissolving rate of the compacted granules. There is no reference in this document to multiple wash cycle performance or, in particular, to the inhibition of incrustation.

According to the teaching of European patent application EP-A-0 542 131, a sodium silicate containing water of crystallization can be produced by treating a 40 to 60% by weight aqueous solution of the sodium silicate with hot air in a turbodryer equipped with percussive tools. The drying product passes through a pseudoplastic state with a free water content of 5 to 12% by weight, based on the paste, which is used to form a granular product. These granules are dried under conditions which preclude embrittlement of the outer shell of the granules and hence disintegration of the granule structure. It is possible in this way—while avoiding the so-called popcorn effect—to produce water-soluble sodium silicates with specific gravities of 0.5 to 1.2 which are distinguished by complete solubility in water at ambient temperature.

Earlier German patent application P 44 00 024.3 describes sodium silicates with a modulus (molar ratio of $SiO_2$ to $Na_2O$) of 1.3 to 4 in the form of a fine-particle solid with a flake structure, these silicates being X-ray-amorphous and having absolute water contents of at most 15% by weight (overdried silicates) and apparent densities below 500 g/l. These X-ray-amorphous silicates are distinguished in particular by the presence of microcrystalline solid regions which can be detected by electron diffraction, but not by X-ray diffraction. By virtue of their flake structure, the silicates in question have a very high specific BET surface. The particle sizes are preferably in the range from 10 to 200 pm. Silicates with an apparent density below 400 g/l and, more particularly, in the range from 100 to 350 g/l are of particular advantage from the performance point of view.

The roll compacting of detergents or cleaning compositions or of individual components of detergents or cleaning compositions is established technical knowledge. It is known even from European patent application EP- A-0 253 323 that builders, such as zeolite and/or phosphate, can be converted by roll compacting into granules with high apparent densities and very good performance properties. The conditions under which roll compacting is normally carried out are described in detail in this document. It is stated that the roll nip pressure and the residence time of the material at the pressure applied have to be adjusted in such a way that a high-density sheet-like compactate is formed. The high degree of compaction is desirable not only for modern detergents or cleaning compositions of high apparent density, but also in the interests of increased abrasion stability of the granules. However, it is important to bear in mind that excessive compacting pressures affect the reliability of the process because they can lead to plasticization of the material on the rolls and hence to blocking. This undesirable effect occurs when an increase in the compacting pressure no longer compacts the material and the force now additionally introduced mainly results in heating and plasticization of the material, for example through partial melting of water-containing components. This is also the reason why roll compacting is normally carried out at ambient temperature and not at externally elevated temperatures.

Accordingly, the problem addressed by the present invention was to provide silicate-based or silicate-containing builders for use in modern detergents or cleaning compositions which, despite their compaction, would still have very good multiple wash cycle performance, particularly in the area of incrustation inhibition.

DESCRIPTION OF THE INVENTION

In a first embodiment, therefore, the present invention relates to a process for the production of silicate-based or silicate-containing builder granules by compaction of light silicates with apparent densities below 500 g/l, sodium silicates with a modulus (molar ratio of $SiO_2$ to $Na_2O$) in the range from 1.3 to 4 which are present in the form of a fine-particle solid with a flake structure, are X-ray amorphous and have absolute water contents of at most 15% by weight being used and apparent densities of at least 600 g/l being established by the compaction process.

The granules according to the invention are produced by compaction, any known methods being available for compaction. However, the roll compaction of silicates with moduli of, preferably, 1.5 to 3.3 and, more preferably, 1.7 to 3.0, for example of the order of 2.0, according to earlier German patent application P 44 00 024.3 is particularly preferred. Where this process is applied, compaction may be carried out completely or in part by roll compaction. In one preferred embodiment of the invention, the light starting silicates are produced in a turbodryer/granulator. Particularly preferred silicates are those which have been dried by a single or multiple repeated drying step to water contents of 0 to at most 15% by weight, preferably 3 to 15% by weight and more preferably 6 to 13% by weight and which in particular have apparent densities below 400 g/l. Depending on the setting of the vanes and on the throughput of air through the turbodryer, apparent densities of 40 g/l to around 400 g/l can be obtained, i.e. at high weights per liter in particular, the turbodryer functions not only as a dryer, but also as a mill. In order to minimize the compaction ratio, the starting material to be compacted preferably has relatively high weights per liter. The weights per liter of very light products can be increased not only in the turbodryer, but also for example in a following mill or other intermediate compacting stages.

Thus, it is possible and generally preferred to size-reduce and, at the same time, to pre-compact light silicates with apparent densities of 40 to 150 g/l to an apparent density of 350 to 400 g/l in a mill. Both size-reduced and non-size-reduced overdried silicates may be used for compacting, size-reduced silicates having advantages in terms of compaction by virtue of the low compaction ratio.

The apparent density of the granules compacted in accordance with the invention may even reach, preferably, 700 g/l to 1100 g/l and, more preferably, 800 to 1000 g/l. In one preferred embodiment of the invention, the compacted silicates are adjusted to an apparent density which is preferably at least twice and, more preferably, at least three times as high as the apparent density of the light starting silicates. The water content of the compacted silicates is 0 to at most 15% by weight. As with the light starting silicates, however, preferred water contents are 3 to 15% by weight and, more particularly, 6 to 13% by weight.

Surprisingly, these compacted silicates show not only an equally good, but even an improved incrustation inhibition capacity by comparison with the relatively light starting silicates although the surface of the compacted granules is smaller than that of the starting silicates with their flake structure. Accordingly, the incrustation inhibition "information", which was characteristic of the light fine-particle silicates with their flake structure, is not only not destroyed, but is transmitted and, preferably, even increased by compaction.

The builder granules produced in accordance with the invention may consist entirely of the optionally water-containing compacted silicates, although they may also contain other components, particularly those known as typical ingredients of detergents or cleaning compositions. In one preferred embodiment of the invention, silicate-containing or silicate-based builder granules are produced using 10 to 100% by weight, preferably 30 to 100% by weight and, more preferably, at least 45% by weight of optionally water-containing silicates. It is immaterial whether the silicate-based starting materials produced and subsequently compacted in accordance with earlier German patent application P 44 00 024.3 already contain these additional components or whether mixtures of the individual components and the relatively light starting silicates are initially produced and compacted. In one preferred embodiment, mixtures of silicates and carbonates in a ratio by weight of 9:1 to 1:9 are used.

Other typical ingredients of detergents or cleaning compositions include, in particular, anionic and nonionic surfactants and other inorganic and organic builders and also bleaching agents and bleach activators, inorganic salts, enzymes and enzyme stabilizers, foam inhibitors, redeposition inhibitors and dye transfer inhibitors.

Preferred surfactants of the sulfonate type are the known $C_{9-13}$ alkyl benzene sulfonates, α-olefin sulfonates and alkane sulfonates. Esters of α-sulfofatty acids and the disalts of α-sulfofatty acids are also suitable. Other suitable anionic surfactants are sulfonated fatty acid glycerol esters which represent the mono-, di- and triesters and mixtures thereof obtained where production is carried out by esterification of a monoglycerol with 1 to 3 moles of fatty acid or in the transesterification of triglycerides with 0.3 to 2 moles of glycerol.

Suitable alkyl sulfates are, in particular, the sulfuric acid monoesters of $C_{12-18}$ fatty alcohols, such as lauryl, myristyl, cetyl or stearyl alcohol, and the fatty alcohol mixtures obtained from coconut, palm and palm kernel oil which may additionally contain unsaturated alcohols, for example oleyl alcohol.

In addition to the anionic surfactants, it is possible in particular to use soaps. Suitable soaps are saturated fatty acid soaps, such as the salts of lauric acid, myristic acid, palmitic acid, stearic acid, hydrogenated erucic acid and behenic acid and soap mixtures derived in particular from natural fatty acids, for example coconut oil, palm kernel oil or tallow fatty acids.

The anionic surfactants may be present in the form of their sodium, potassium or ammonium salts and as soluble salts of organic bases, such as mono-, di- or triethanolamine. The anionic surfactants are preferably present in the form of their sodium or potassium salts, more particularly in the form of their sodium salts.

The nonionic surfactants used are preferably alkoxylated, advantageously ethoxylated, more particularly primary, alcohols preferably containing 8 to 18 carbon atoms and an average of 1 to 12 moles of ethylene oxide (EO) per mole of alcohol, in which the alcohol radical may be linear or, preferably, 2-methyl-branched or may contain linear and methyl-branched radicals in the form of the mixtures typically present in oxoalcohol radicals. However, alcohol ethoxylates with linear radicals of alcohols of native origin containing 12 to 18 carbon atoms, for example of coconut oil, palm kernel oil, tallow fatty alcohol or oleyl alcohol, and an average of 2 to 8 EO per mole of alcohol are particularly preferred. Preferred ethoxylated alcohols include, for example, $C_{12-14}$ alcohols containing 3 EO or 4 EO, $C_{9-11}$alcohol containing 7 EO, $C_{13-15}$ alcohols containing 3 EO, 5 EO, 7 EO or 8 EO, $C_{12-18}$ alcohols containing 3 EO, 5 EO or 7 EO and mixtures thereof, such as mixtures of $C_{12-14}$ alcohol containing 3 EO and $C_{12-18}$ alcohol containing 5 EO. The degrees of ethoxylation mentioned represent statistical mean values which, for a particular product, may be either a whole number or a broken number. Preferred alcohol ethoxylates have a narrow homolog distribution (narrow-range ethoxylates, NRE). Fatty alcohols containing more than 12 EO, for example tallow fatty alcohol containing 14 EO, 25 EO, 30 EO or 40 EO, may be used in addition to these nonionic surfactants.

Other suitable nonionic surfactants are alkyl glycosides corresponding to the general formula $RO(G)_x$, where R is a primary linear or methyl-branched, more particularly 2-methyl-branched, aliphatic radical containing 8 to 22 and preferably 12 to 18 carbon atoms and G is a glycose unit containing 5 or 6 carbon atoms, preferably glucose. The degree of oligomerization x, which indicates the distribution of monoglycosides and oligoglycosides, is a number of 1 to 10, preferably assuming a value of 1.2 to 1.4.

Another class of preferred nonionic surfactants which may be used either as sole nonionic surfactant or in combination with other nonionic surfactants, more particularly together with alkoxylated fatty alcohols, are alkoxylated, preferably ethoxylated or ethoxylated and propoxylated fatty acid alkyl esters, preferably containing 1 to 4 C atoms in the alkyl chain, more especially the fatty acid methyl esters which are described, for example, in Japanese patent application JP 58/217598 or which are preferably produced by the process described in International patent application WO-A-9011 3533.

Nonionic surfactants of the amine oxide type, for example N-cocoalkyl-N,N-dimethylamine oxide and N-tallowalkyl-N,N-dihydroxyethyl amine oxide, and the fatty acid alkanolamide type are also suitable. The quantity in which these nonionic surfactants are used is preferably no more than the quantity of ethoxylated fatty alcohols used, in particular no more than half that quantity.

Other suitable surfactants are polyhydroxyfatty acid amides corresponding to formula (1):

$$R^2-\overset{\overset{R^3}{|}}{CO}-N-[Z] \qquad (I)$$

in which $R^2CO$ is an aliphatic acyl radical containing 6 to 22 carbon atoms, $R^3$ is hydrogen, an alkyl or hydroxyalkyl radical containing 1 to 4 carbon atoms and [Z] is a linear or branched polyhydroxyalkyl radical containing 3 to 10 carbon atoms and 3 to 10 hydroxyl groups. The polyhydroxyfatty acid amides are known substances which are normally obtained by reductive amination of a reducing sugar with ammonia, an alkylamine or an alkanolamine and subsequent acylation with a fatty acid, a fatty acid alkyl ester or a fatty acid chloride.

Finely crystalline synthetic zeolite containing bound water, for example, may be used as an additional builder. Zeolite NaA is particularly suitable although zeolite P and mixtures of A, X and/or P may also be used. Suitable substitutes or partial substitutes for zeolites are crystalline layer-form sodium silicates having the general formula $NaMSi_xO_{2x+1}\cdot yH_2O$, where M is sodium or hydrogen, x is a number of 1.9 to 4 and y is a number of 0 to 20, preferred values for x being 2, 3 or 4. Corresponding crystalline layer silicates are described, for example, in European patent application EP-A-0 164 514. Preferred crystalline layer silicates are those in which M stands for sodium and x assumes a value of 2 or 3. Both β- and δ-sodium disilicates $Na_2Si_{2O5}\cdot yH_2O$ are particularly preferred, β-sodium disilicate being obtainable able, for example, by the process described in International patent application WO-A-91/08171.

In one preferred embodiment of the invention, however, the granules produced in accordance with the invention contain at most 50% by weight, based on the sum of zeolite, X-ray-amorphous and crystalline layer-form silicates, of zeolite and crystalline layer-form silicates.

Useful organic builders are, for example, the polycarboxylic acids preferably used in the form of their sodium salts, such as citric acid, adipic acid, succinic acid, glutaric acid, tartaric acid, sugar acids, aminocarboxylic acids, nitrilotriacetic acid (NTA), providing their use is not ecologically unsound, and mixtures thereof. Preferred salts are the salts of polycarboxylic acids, such as citric acid, adipic acid, succinic acid, glutaric acid, tartaric acid, sugar acids and mixtures thereof.

Suitable polymeric polycarboxylates are, for example, the sodium salts of polyacrylic acid or polymethacrylic acid, for example those having a relative molecular weight of 800 to 150,000 (based on acid). Suitable copolymeric polycarboxylates are, in particular, those of acrylic acid with methacrylic acid and of acrylic acid or methacrylic acid with maleic acid. Copolymers of acrylic acid with maleic acid containing 50 to 90% by weight of acrylic acid and 50 to 10% by weight of maleic acid have proved to be particularly suitable. Their relative molecular weight, based on free acids, is generally in the range from 5,000 to 200,000, preferably in the range from 10,000 to 120,000 and more preferably in the range from 50,000 to 100,000. Terpolymers, for example those which contain as monomers salts of acrylic acid and maleic acid and also vinyl alcohol or vinyl alcohol derivatives (DE 43 00 772.4) or salts of acrylic acid and 2-alkyl allyl sulfonic acid and sugar derivatives (DE 42 21 381), are also particularly preferred.

Other suitable builder systems are the oxidation products of carboxyfunctional polyglucosans and/or water-soluble salts thereof which are described, for example, in International patent application WO-A-93/08251 or of which the production is described, for example, in International patent application WO-A-93/16110 or in earlier German patent application P 43 30 393.0.

In addition, the process may also be carried out using components with a positive effect on the removability of oil and fats from textiles by washing. This effect becomes particularly clear when a textile which has already been repeatedly washed with a detergent according to the invention containing this oil- and fat-dissolving component is soiled. Preferred oil- and fat-dissolving components include, for example, nonionic cellulose ethers, such as methyl cellulose and, in particular, methyl hydroxypropyl cellulose containing 15 to 30% by weight of methoxyl groups and 1 to 15% by weight of hydroxypropoxyl groups, based on the nonionic cellulose ether, and the polymers of phthalic acid and/or terephthalic acid known from the prior art or derivatives thereof, more particularly polymers of ethylene terephthalates and/or polyethylene glycol terephthalates or anionically and/or nonionically modified derivatives thereof.

Components which further improve the solubility of the compacted and, basically, readily soluble granules may also be used in the process. Corresponding components are described, for example, in International patent application WO-A-93/02176 and in German patent application DE 42 03 031. Preferred components of the type in question include in particular fatty alcohols containing 10 to 80 moles of ethylene oxide per mole of fatty alcohol, for example tallow fatty alcohol containing 30 EO and tallow fatty alcohol containing 40 EO, and polyethylene glycols with a relative molecular weight of 200 to 2,000.

Other suitable ingredients of the granules produced in accordance with the invention are water-soluble inorganic salts, such as bicarbonates, carbonates, typical amorphous silicates or mixtures thereof. According to the teaching of earlier German patent application P 43 19 578.4, alkali metal carbonates may also be replaced by sulfur-free amino acids containing 2 to 11 carbon atoms and optionally another carboxyl and/or amino group and/or salts thereof. According to this invention, the alkali metal carbonates are preferably partly or completely replaced by glycine or glycinate.

Among the compounds yielding $H_{2O\ 2}$ in water which serve as bleaching agents, sodium perborate tetrahydrate and sodium perborate monohydrate are of particular importance. Other useful bleaching agents are, for example, sodium percarbonate, peroxypyrophosphates, citrate per- hydrates and $H_{2O2}$-yielding peracidic salts or peracids, such as perbenzoates, peroxophthalates, diperazelaic acid or diperdodecanedioic acid.

To achieve an improved bleaching effect where washing is carried out at temperatures of 60° C. or lower, bleach activators may optionally be incorporated in the granules. Examples of suitable bleach activators are N-acyl or O-acyl compounds which form organic peracids with $H_{2O2}$, preferably N,N'-tetraacylated diamines, p-(alkanoyloxy)-benzenesulfonate, also carboxylic anhydrides and esters of polyols, such as glucose pentaacetate. Other known bleach activators are acetylated mixtures of sorbitol and mannitol as described, for example, in European patent application EP-A-0 525 239. Particularly preferred bleach activators are N,N,N',N'-tetraacetyl ethylenediamine (TAED), 1,5-diacetyl-2,4-dioxohexahydro-1,3,5-triazine (DADHT) and acetylated sorbitol/mannitol mixtures (SORMAN).

Where the granules are used in machine washing processes, it can be of advantage to add typical foam inhibitors to them. Suitable foam inhibitors are, for example, soaps of natural or synthetic origin with a high percentage content of $C_{18-24}$ fatty acids. Suitable non-surface-active foam inhibitors are, for example, organopolysiloxanes and mixtures thereof with microfine, optionally silanized silica and also paraffins, waxes, microcrystalline waxes and mixtures thereof with silanized silica or bis-stearyl ethylenediamide. Mixtures of various foam inhibitors, for example mixtures of silicones, paraffins or waxes, are also used with advantage. The foam inhibitors, more particularly silicone- or paraffin-containing foam inhibitors, are preferably fixed to a granular water-soluble or water-dispersible support. Mixtures of paraffins and bis-stearyl ethylenediamides are particularly preferred. In one preferred embodiment, however, silicate-containing granules produced in accordance with the invention do not contain these foam inhibitors, instead they are optionally present in the detergents or cleaning formulations in which the granules according to the invention are preferably used.

Suitable enzymes are those from the class of proteases, lipases, amylases, cellulases and mixtures thereof. Enzymes obtained from bacterial strains or fungi, such as *Bacillus subtilis, Bacillus licheniformis* and *Streptomyces griseus*, are particularly suitable. Proteases of the *subtilisin* type are preferably used, proteases obtained from *Bacillus lentus* being particularly suitable. Enzyme mixtures, for example mixtures of protease and amylase or protease and lipase or protease and cellulase or mixtures of cellulase and lipase or mixtures of protease, amylase and lipase or protease, lipase and cellulase, but especially cellulase-containing mixtures, are of particular interest. (Per)oxidases have also proved to be suitable in some cases. The enzymes may be adsorbed to supports and/or encapsulated in shell-forming substances to protect them against premature decomposition. The percentage content of enzymes, enzyme mixtures or enzyme granules may be, for example, of the order of 0.1 to 5% by weight and preferably from 0.1 to around 2% by weight.

Suitable stabilizers, particularly for per compounds and enzymes, are the salts of polyphosphonic acids, more particularly 1-hydroxyethane-1,1-diphosphonic acid (HEDP), diethylenetriamine pentamethylenephosphonic acid (DETPMP) or ethylenediamine tetramethylenephosphonic acid.

The function of redeposition inhibitors is to keep the soil detached from the fibers suspended in the wash liquor and thus to prevent discoloration. Suitable redeposition inhibitors are water-soluble, generally organic colloids, for example the water-soluble salts of polymeric carboxylic acids, glue, gelatine, salts of ether carboxylic acids or ether sulfonic acids of starch or cellulose or salts of acidic sulfuric acid esters of cellulose or starch. Water-soluble polyamides containing acidic groups are also suitable for this purpose. Soluble starch preparations and other starch products than those mentioned above, for example degraded starch, aldehyde starches, etc., may also be used. Polyvinyl pyrrolidone is also suitable. However, cellulose ethers, such as carboxymethyl cellulose (Na salt), methyl cellulose, hydroxyalkyl cellulose, and mixed ethers, such as methyl hydroxyethyl cellulose, methyl hydroxypropyl cellulose, methyl carboxymethyl cellulose and mixtures thereof, and polyvinyl pyrrolidone may also be used, for example in quantities of 0.1 to 5% by weight, based on the detergent.

The granules produced in accordance with the invention may contain derivatives of diaminostilbene disulfonic acid or alkali metal salts thereof as optical brighteners. Suitable optical brighteners are, for example, salts of 4,4'-bis-(2-anilino-4-morpholino-1,3,5-triazinyl-6-amino)-stilbene-2,2'-disulfonic acid or compounds of similar composition which contain a diethan-olamino group, a methylamino group, an anilino group or a 2-methoxy-ethylamino group instead of the morpholino group. Brighteners of the substituted diphenyl styryl type, for example alkali metal salts of 4,4'-bis-(2-sulfostyryl)-diphenyl, 4,4'-bis-(4-chloro-3-sulfostyryl)-diphenyl or 4-(4-chlorostyryl)4'-(2-sulfostyryl)-diphenyl, may also be present. Mixtures of the brighteners mentioned above may also be used.

In one particularly advantageous embodiment of the invention, however, heavy silicate-based or silicate-containing builder granules with an apparent density of at least 850 g/l are produced. The builder granules in question are, in particular, builder granules which consist of 100% by weight of optionally water-containing silicates with a modulus of 1.7 to 3.0, water contents of 3 to 15% by weight and, more particularly, 6 to 13% by weight being preferred.

The apparent densities may be established by one or more compaction steps, of which a first compaction step may even be carried out by size reduction, as mentioned above. In one particularly preferred embodiment, apparent densities of 800 g/l and higher can be established by two or three compaction steps starting from flake silicates with apparent densities below 200 g/l.

In one preferred embodiment of the invention, the relatively light starting silicates are directly roll-compacted without preliminary precompaction. The pair of rollers may be arranged in any spatial direction, i.e. in particular vertically or horizontally to one another. The mixture to be compacted or the sole relatively light silicate starting material is then delivered to the role nip either by gravity feeding or by means of a suitable unit, for example a tamping screw. The material to be compacted is then passed under pressure through the gap between a pair of rollers rotating in opposite directions at substantially the same speed and, in the process, is compacted to form a sheet-like compactate. The pressure applied is generally between 7 and 30 kN/cm roll length and, more particularly, between 10 and 25 kN/cm roll length. The silicate-based starting materials used in accordance with the invention or rather the silicate-containing. starting materials or mixtures may be roll-compacted in dry form, particularly where the silicates have water contents of at least 6% by weight, based on the silicates. Only where the silicates contain no water of hydration may a small quantity of water optionally be added, depending on the nature of the other raw materials. However, the roll compaction process is preferably carried out in the absence of added water.

It has been found that the roll compaction process carried out in accordance with the invention can not only readily be carried out at relatively high temperatures, the dissolving behavior of the roll-compacted builder granules in particular can also be improved by this elevated temperature in particular when the builder granules also contain crystalline layer-form silicates in addition to amorphous or X-ray-amorphous silicates. Roll temperatures of 35° to 120° C. may be applied, temperatures of 40° to 100° C. and, more particularly, 45° to 90° C. being particularly preferred.

The sheet-form compactate is then size-reduced. This size-reducing or grinding step may be carried out, for example, in a mill and results in the formation of so-called splinter granules which can be ground even more finely. The size-reduced material is then best subjected to a grading process in which coarse material is removed and returned to the size-reducing unit while overly fine material is recompacted with other starting materials in the roll gap. The sheet-form compactate is converted by conventional grinding into granules with a particle size distribution of 0.05 mm to around 2 mm and preferably with a particle size distribution in which at least 70% by weight of granules have a diameter of 0.1 to 1.6 mm, while fine particles below 0.05 mm in diameter are recompacted and coarse particles larger than 2 mm in diameter are returned to the grinding stage. If desired or necessary, the roll-compacted granules may also be subjected overall to one or more other compaction steps which need not consist solely in roll compaction, but may also be carried out by other known compacting measures. However, the other compacting steps are also preferably carried out by roll compaction.

The silicate-containing builder granules produced in accordance with the invention, which preferably contain up to 90% by weight of other typical ingredients of detergents or cleaning compositions, may be used per se as detergents or cleaning compositions. However, the silicate-containing or silicate-based builder granules produced in accordance with the invention may also be used as an additive component for all modern detergents or cleaning compositions. Corresponding formulations are also the subject of the present invention. Particularly preferred granular detergents or cleaning compositions are those which have apparent densities of at least 600 g/l, preferably of at least 700 g/l and, more preferably, of at least 750 g/l. The detergents or cleaning compositions preferably contain biodegradable surfactants, for example fatty alkyl sulfates and/or ethoxylated fatty alcohols and/or soaps and/or alkyl polyglycosides, and optionally biodegradable polymers as co-builders. These detergents or cleaning compositions may have been produced by any of the known processes, including extrusion, granulation and the combined technique.

EXAMPLE

A 50% by weight aqueous sodium silicate solution with a ratio by weight of $Na_2O$ to $SiO_2$ of 1:2.0 was dried in two stages with hot air at 220° C. in a Vomm turbodryer/granulator (manufacturer: Vomm, Italy) at a wall temperature of 170° C. The silicate-containing product of the first drying stage had a residual water content of 17% by weight and an apparent density of 850 g/l. After passing through the second drying stage, a residual water content of 9% by weight was reached for an apparent density of 130 g/l. The silicate was present in X-ray-amorphous form and had the typical flake structure described in earlier German patent application P 44 00 024.3. The silicate was compacted in three stages under a pressure of 17 kN/cm. The compactates formed were size-reduced through a 2 mm sieve. The silicate had an apparent density of 900 g/l.

The light starting silicate (130 g/l) and the silicate according to the invention (900 g/l) were performance-tested for incrustation inhibition in a test apparatus consisting of a stainless steel container with a holding capacity of 10 liters which was heated with a heating coil of the type used in drum-type washing machines. In each cycle, 10 liters of silicate solution containing 16.7 g of the particular silicate were circulated in the container with a propeller stirrer and heated for 30 minutes to 90° C. and kept at 90° C. for another 30 minutes (so that the time/temperature curve corresponded to a standard oil-wash program). The hot silicate solution was then drained off and the container was briefly rinsed with 5 liters of cold water before the next cycle began. After the fifth cycle, the heating coil was removed from the container and was first heated to 80° C. in aqueous citric acid to dissolve the deposits. Dissolution of the deposits was then completed over a period of 30 minutes after alkalization of the solution with sodium hydroxide and addition of nitrilotriacetic acid sodium salt. The content of CaO in the solution was directly determined by optical emission spectrometry (ICP-OC). To this end, the liquid sample was evaporated and energized in a gas ionized by high frequency. Tap water which had been adjusted to a hardness of 30°d by the addition of calcium and magnesium chloride in a ratio of calcium to magnesium of 5:1, was used to prepare the silicate solution and to rinse the container.

The deposits of calcium on the heating coil were 322 mg CaO for the light starting silicate and 56 mg CaO for the silicate according to the invention.

For Comparison

In this test, Portil®A (spray-dried soda waterglass with a modulus of 2 and an ignition loss (800° C.) of around 18%; a product of Henkel KGaA, Germany) produced calcium deposits on the heated coil of 280 mg CaO. SKS-6® (crystalline layer-form sodium disilicate; a product of Hoechst AG, Germany) still produced 92 mg of CaO under the same conditions.

What is claimed is:

1. The process of producing silicate or silicate-containing builder granules having an apparent density of at least 600 g/l comprising compacting X-ray amorphous sodium silicates of flake structure having an apparent density of less than 500 g/l, a molar ratio of $SiO_2$ to $Na_2O$ of 1.3 to 4, and a water content of up to 15% by weight, said compacting being conducted at a pressure of between about 7 and about 30 kN/cm roll length and a temperature of from 35° C. to 120° C. and present in the form of a fine particle solid having a flake structure.

2. A process as in claim 1 wherein said builder granules have an apparent density of 700 g/l to 1100 g/l.

3. A process as in claim,1 wherein said compacting step is carried out by roll compaction.

4. A process as in claim 1 including a step of size-reducing and simultaneously pre-compacting said silicates prior to said compacting step.

5. A process as in claim 1 wherein said silicates have an apparent density of less than 400 g/l.

6. A process as in claim 1 wherein said compacting step is conducted until said builder granules have an apparent density at least twice as great as the apparent density of the starting silicates.

7. A process as in claim 1 wherein said builder granules have an apparent density of at least 850 g/l, and consist of 100%/wt of water-containing silicates having a molar ratio of $SiO_2$ to $Na_2O$ of 1.7 to 3.0.

8. A process as in claim 1 wherein said silicates have an apparent density of less than 200 g/l and said builder granules have an apparent density of at least 800 g/l produced by compacting in two or three steps.

9. A process as in claim 1 wherein said compacting step is conducted at a temperature of 45° C. to 100° C.

10. A process as in claim 1 wherein said compacting step is conducted in the absence of added water.

11. A process as in claim 1 wherein said silicates are size-reduced after said compacting step.

12. A process as in claim 11 including subjecting the size-reduced silicates to a grading step.

13. A process as in claim 12 wherein said silicates have a particle size distribution of 0.05 mm to about 2 mm.

* * * * *